US009194033B2

(12) United States Patent
Makino et al.

(10) Patent No.: US 9,194,033 B2
(45) Date of Patent: Nov. 24, 2015

(54) METHOD FOR PRODUCING STEEL MATERIAL FOR FRICTION WELDING

(71) Applicant: AICHI STEEL CORPORATION, Tokai-shi (JP)

(72) Inventors: Komei Makino, Aichi (JP); Hiroyuki Mizuno, Aichi (JP)

(73) Assignee: AICHI STEEL CORPORATION, Tokai-shi (JP)

( * ) Notice: Subject to any disclaimer, the term of this patent is extended or adjusted under 35 U.S.C. 154(b) by 0 days.

(21) Appl. No.: 14/380,132

(22) PCT Filed: Mar. 27, 2013

(86) PCT No.: PCT/JP2013/059000
§ 371 (c)(1),
(2) Date: Aug. 21, 2014

(87) PCT Pub. No.: WO2013/146880
PCT Pub. Date: Oct. 3, 2013

(65) Prior Publication Data

US 2015/0159247 A1 Jun. 11, 2015

(30) Foreign Application Priority Data

Mar. 30, 2012 (JP) ..... 2012-079814

(51) Int. Cl.

| | |
|---|---|
| ***C21D 8/02*** | (2006.01) |
| ***C22C 38/60*** | (2006.01) |
| ***C21D 8/06*** | (2006.01) |
| ***C22C 38/00*** | (2006.01) |
| ***C21D 6/00*** | (2006.01) |
| ***C22C 38/02*** | (2006.01) |
| ***C22C 38/04*** | (2006.01) |
| ***C22C 38/06*** | (2006.01) |
| ***C22C 38/18*** | (2006.01) |
| ***C21D 8/00*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |

(52) U.S. Cl.

CPC ..... *C22C 38/60* (2013.01); *C21D 6/002* (2013.01); *C21D 6/005* (2013.01); *C21D 6/008* (2013.01); *C21D 8/005* (2013.01); *C21D 8/06* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/18* (2013.01); *C22C 38/22* (2013.01); *C22C 38/24* (2013.01); *C22C 38/26* (2013.01); *C22C 38/28* (2013.01)

(58) Field of Classification Search
None
See application file for complete search history.

(56) References Cited

U.S. PATENT DOCUMENTS 8,430,977 B2 * 4/2013 Hisada et al. ..... 148/333

FOREIGN PATENT DOCUMENTS

| | | |
|---|---|---|
| CN | 101268208 A | 9/2008 |
| CN | 101688275 A | 3/2010 |
| JP | 2-228447 | 9/1990 |
| JP | 2-267218 | 11/1990 |
| JP | 2001-234282 | 8/2001 |
| JP | 2011-184742 | 9/2011 |
| JP | 2012-57213 | 3/2012 |

OTHER PUBLICATIONS

International Search Report issued Jul. 2, 2013, in PCT/JP2013/059000, filed Mar. 27, 2013.
First Office Action in Chinese application No. 201380017155.X, issued Jul. 1, 2015, with English Translation.

* cited by examiner

*Primary Examiner* — Deborah Yee
(74) *Attorney, Agent, or Firm* — Oblon, McClelland, Maier & Neustadt, L.L.P.

(57) ABSTRACT

A chemical composition includes, in mass percent, C: 0.30 to 0.55%, Si: 0.05 to 1.0%, Mn: 0.05 to 0.9%, P: 0.001 to 0.030%, S: 0.005 to 0.12%, Cr: 0.05 to 2.0%, Al: 0.005 to 0.05%, N: 0.0050 to 0.0200%, and the balance being Fe and unavoidable impurities, an amount of N in solid solution being not less than 0.0020%, wherein the contents of Mn and S satisfy relationships expressed by the following expressions:

$$2.6 \leq Mn/S < 15 \quad (1) \text{ and}$$

$$Mn + 6S < 1.2 \quad (2).$$

7 Claims, No Drawings

METHOD FOR PRODUCING STEEL MATERIAL FOR FRICTION WELDING

TECHNICAL FIELD

The present invention relates to a steel material for friction welding and a method for producing the steel material, the steel material being joined to another steel material by friction welding.

BACKGROUND ART

One of methods for joining two steel members is friction welding that involves bringing joining surfaces of these members into abutment with each other and relatively rotating the members to generate frictional heat whereby softening the joining surfaces, and applying high pressurizing force to the members to form diffusion bonding between the members. Friction welding is employed to manufacture various components, such as propeller shafts for automobiles.

The steel material for friction welding is often required not only to have high friction weldability, but also to have good machinability. For example, the propeller shafts described above are manufactured being subjected to not only friction welding but also machining.

It has been well known that addition of Pb is effective for improvements in the machinability of steel. In contrast, environmental concerns demand Pb-free steel without Pb addition. The addition of S in place of Pb can provide steel with improved machinability; however, which machinability is barely compatible with the friction weldability.

Patent literature 1 discloses a Pb-free steel material for machine structures suitable for friction welding, wherein N is preliminarily present in the form of a compound while the content of N in solid solution is regulated to 0.0015% or less, and the number of MnS grains with a certain size is controlled. This patent further describes that, for the regulation of the content of N in solid solution and the control of the MnS grains, a billet should be heated at a temperature in the range of 1000 to 1250° C. and the temperature should be maintained within the range of 800 to 1000° C. from the start to the end of the hot rolling (Paragraph 0091).

Furthermore, the patent describes that a change in existing form of N present in the steel before and after the friction welding can improve the joining strength after the friction welding, cold workability, and machinability (Paragraph 0029).

CITATION LIST

Patent Literature

Patent Literature 1: JP-A-2011-184742

SUMMARY OF INVENTION

Problem to be Solved by the Invention

The steel material in Patent Literature 1 has no problem in friction weldability, however, it does not achieve sufficient improvements in chip disposability and tool wear resistance which are evaluation items concerning the machinability in machining conducted after the hot working, due to a low content of N in solid solution and a high content of N in a form of a compound. Further, a relatively low temperature required for hot rolling and hot forging of the steel results in a problem of poor hot workability.

In view of the background as described above, the present invention is intended to provide a steel material for friction welding having superior chip disposability and tool wear resistance during machining and also having superior hot workability, and a method for producing the steel material.

Means for Solving the Problem

One aspect of the present invention provides a steel material for friction welding having a chemical composition including, in mass percent, C: 0.30 to 0.55%, Si: 0.05 to 1.0%, Mn: 0.05 to 0.9%, S: 0.005 to 0.12%, Cr: 0.22 to 2.00%, Al: 0.005 to 0.05%, N: 0.0050 to 0.0200%, and the balance being Fe and unavoidable impurities, wherein an amount of N in solid solution is not less than 0.0020%, and wherein the contents of Mn and S satisfy relationships expressed by following expressions:

$$2.6 \leq Mn/S < 15 \quad (1) \text{ and}$$

$$Mn+6S < 1.2 \quad (2)$$

in which Mn and S represent the contents in mass percent of manganese and sulfur, respectively.

Another aspect of the present invention provides a method for producing a steel material for friction welding, including:

preparing a material having a chemical composition comprising, in mass percent, C: 0.30 to 0.55%, Si: 0.05 to 1.0%, Mn: 0.05 to 0.9%, S: 0.005 to 0.12%, Cr: 0.22 to 2.00%, Al: 0.005 to 0.05%, N: 0.0050 to 0.0200%, the balance being Fe and inavoidable impurities, wherein the contents of Mn and S satisfy relationships expressed by following expressions:

$$2.6 \leq Mn/S < 15 \quad (1) \text{ and}$$

$$Mn+6S < 1.2 \quad (2)$$

in which Mn and S represent the contents in mass percent of manganese and sulfur, respectively, hot-working the material at least one time, the last hot working being performed at a working temperatures exceeding 950° C., and cooling the material after the last hot working at a cooling rate of 0.3° C./sec or more at least until the temperature reaches 500° C.

Advantageous Effects of the Invention

The steel material for friction welding described above has the chemical composition specified above, wherein the relationship between Mn and S contents is regulated to satisfy Expressions (1) and (2), and the content of N in solid solution is controlled to the specific value described above. The satisfaction of all of these requirements allows for the generation of fine MnS grains in the step of melting and casting without a change in the existing form of N present in the steel during the friction welding as described in Patent Literature 1, which leads to not only excellent friction weldability but excellent chip disposability and high tool wear resistance during machining, and also hot workability.

On friction weldability, the regulation of the Mn and S contents, especially satisfaction of the relationship expressed by Expression (2): $Mn+6S<1.2$ can prevent the generation of coarse MnS grains in the casting step and eliminate disadvantages caused by the coarse MnS grains present at the pressure welded portions, thus preventing a reduction in strength at the pressure welded portions.

The improvement in tool wear resistance may be attributed to nitrides on the surface of the tool, which is generated from a relatively large amount of N in solid solution which is contained in the steel during machining. The nitrides are believed to act as a coating layer to restrain abrasions of the cutting tool.

The improvement in chip disposability during machining may be attributed to the regulation of the Mn and S contents, especially satisfaction of the relationship expressed by Expression (1): Mn/S<15, which achieves dispersion of fine MnS having a grain size of 1 μm or less in a large amount. The large amount of the fine Mns is believed to act as sources of stress concentration during machining to improve chip breakability.

The improvement in hot working may be attributed to the regulation of the Mn and S contents, especially satisfaction of the relationship expressed by Expression (1): 2.6≤Mn/S, which restrains generation of FeS at grain boundaries to inhibit the increase in hot brittleness caused by the presence of FeS. The improvement in the hot workability can also be achieved by a relatively high temperature suitable for the hot working because a specific amount of N in solid solution requires such a relatively high hot-working temperature.

Furthermore, in the above-described method for producing the steel material for friction welding, a raw material having the chemical composition as specified above, wherein the relationship between the Mn and S contents is regulated to satisfy Expressions (1) and (2), is used. Thus, an ingot prepared by casting contains MnS controlled to be fine and FeS the generation of which is restrained at the grain boundaries.

Furthermore, in the last hot working described above, the temperature for the hot working, specifically the temperature of the steel material throughout the hot working, rather than the heating temperature before the hot working, is controlled to exceed 950° C. Thus, N preliminarily present in the form of a compound in the steel is allowed to enter into the matrix of the steel to increase the content of N in solid solution. Furthermore, the increase in the cooling rate after the hot working as described above prevents the precipitation of N, resulting in maintaining at least the predetermined content of the dissolved N.

Accordingly, the resulting steel material for friction welding can achieve not only excellent friction weldability, but also improved chip disposability and tool wear resistance during machining due to fine dispersion of MnS and a required amount of N in solid solution.

MODE FOR CARRYING OUT THE INVENTION

The reasons for limitation of the contents of individual elements in the chemical composition in the above-described steel material for friction welding will now be described.

C (carbon): 0.30 to 0.55%

C is a fundamental element for achieving a required strength. A significantly low C content cannot ensure a strength required for mechanical structures or automobile parts, such as propeller shafts. In contrast, an excessively high C content lowers the toughness and also deteriorates machinability and workability. Accordingly, the C content is set to a range of 0.30 to 0.55%, preferably 0.35 to 0.55%

Si: 0.05 to 1.0%

Si (silicon) is an indispensable element as a deoxidizing agent during steelmaking and also acts as a solid solution strengthening element to effectively improve the strength. Disadvantageously, a significantly low Si content cannot provide the sufficient effect, whereas an excessively high Si content reduces machinability. Accordingly, the Si content is set to a range of 0.05 to 1.0%.

Mn: 0.05 to 0.9%

Mn (manganese) is an element effective for achieving a required strength and for improving the machinability by forming MnS combined with S. A significantly low Mn content causes generation of FeS at the grain boundaries to increase the hot brittleness, leading to the problems such as rolling crack, whereas an excessively high Mn content disadvantageously increases the strength to reduce the machinability. Accordingly, the Mn content is set to a range of 0.05 to 0.9%, preferably 0.05 to 0.8%, and more preferably 0.05 to 0.7%.

S: 0.005 to 0.12%

S (sulfur) is an element effective for improving the machinability by forming MnS combined with Mn.

Disadvantageously, a significantly low S content cannot provide sufficient machinability, whereas an excessively high S content decreases hot workability and fricition weldability. Accordingly, the S content is set to a range of 0.005 to 0.12%, preferably 0.010 to 0.10%, and more preferably 0.020 to 0.08%.

Cr: 0.22 to 2.00%

Cr (chromium), like Mn, is an element effective for achieving a required strength. An excessively high Cr content increases the strength so much, which increase may adversely affect the machinability. Accordingly, the Cr content is set to 2.0% or less, while the Cr content is set to 0.22% or more, for achieving the sufficient effect due to the presence of Cr.

Al: 0.005 to 0.05%

Al (Aluminum) is an element effective as a deoxidizing agent during steelmaking. Disadvantageously, a significantly low Al content leads to insufficient effect in spite of the presence of Al, whereas an excessively high Al content causes generation of AlN combined with N, resulting in a reduction of the amount of N in solid solution. Accordingly, the Al content is set to a range of 0.005 to 0.05%, preferably 0.005 to 0.04%, and more preferably 0.005 to 0.03%.

N: 0.0050 to 0.0200%

N (nitrogen) in solid solution in the steel functions as an element effective for improving machinability. Disadvantageously, a significantly low N content cannot provide sufficient machinability, whereas an excessively high N content will cause cracking of a cast slab during a casting process. Accordingly, the N content is set to a range of 0.0050 to 0.0200%.

N in Solid Solution: 0.0020% or More

The amount of N in solid solution is calculated by subtracting the content of N present in the form of compounds from the total N content in the steel. The amount of N present in the form of compounds can be determined as follows. The steel test material was electrolytically treated in an electrolyte solution of methanol with addition of acetyl acetone, and the electrolyte solution was filtered to give a residue which is used for determining the N content in accordance with Ammonia Distillation Separation Amidosulfuric Acid Titration Method. A significantly low content of N in solid solution cannot provide a sufficient improvement in machinability due to increased tool wear resistance. Accordingly, the content of N in solid solution is set at 0.0020% or more, preferably 0.0030% or more, and more preferably 0.0040% or more.

Furthermore, the Mn and S contents in the chemical composition of the above-described steel material for friction welding satisfies the relationship expressed by Expressions below:

$$2.6 \leq Mn/S < 15 \quad (1) \text{ and}$$

$$Mn + 6S < 1.2 \quad (2)$$

in which Mn and S in the expressions represent the contents in mass percent of manganese and sulfur, respectively.

$2.6 \leq Mn/S < 15$

Firstly, the prescribed relationship expressed by $2.6 \leq Mn/S$ is an effective definition to prevent a reduction in hot workability. If the ratio Mn/S is below 2.6, FeS is produced at the grain boundaries, leading to increase in hot brittleness, so that damage such as a rolling crack is likely to occur. Secondly, the prescribed relationship expressed by $Mn/S < 15$ is an effective definition for improving chip disposability. That is, if the ratio Mn/S is 15 or less, the proportion of MnS crystallized from the liquid phase during solidification is reduced and the proportion of MnS precipitated from the solid phase is increased, so that fine MnS grains having a grain size of 1 μm or less are generated in a large amount. These MnS grains act as sources of stress concentration during machining to enable chips to be efficiently broken, which results in improved chip disposability. Such an effect is difficult to be achieved if the ratio Mn/S is 15 or more.

$Mn + 6S < 1.2$

This relationship is effective to inhibit a decrease in pressure weld strength (strength of a weld portion subjected to friction welding) due to MnS. If Mn+6S is 1.2 or more, the yield of crystallized MnS to be produced during casting increases, resulting in the generation of the coarse MnS grains. The coarse MnS grains remain on the pressure welded portion in a state of being stretched during pressure welding and reduce the strength of the pressured welding portion by a notching effect.

In the method for producing the above-described steel material for friction welding, a material having the chemical composition specified above is prepared. The material is, for example, an ingot prepared by a conventional smelting method. The ingot may have fine dispersion of MnS grains by regulating the Mn and S contents as described above. Meanwhile, in the ingot, most of N contained therein is precipitated in the form of compounds because the cooling rate after casting is relatively slow.

Then, hot working is performed one time or multiple times on the material described above. In the case of multiple times of hot workings, the last hot working is performed under the specific conditions described above. If the hot working is performed only one time, the hot working corresponds to the last hot working. The last hot working prior to machining is performed under the specific conditions described above, that is, at a working temperatures exceeding 950° C., and the cooling after the hot working is continued at least until the temperature reaches 500° C. at a cooling rate of 0.3° C./sec or more, preferably 0.4° C./sec or more, and more preferably 0.5° C./sec or more. As described above, the working temperature refers to the temperature of the steel material throughout the hot working, rather than the heating temperature before the hot working.

The hot working performed at relatively high working temperatures and subsequent cooling according to the specific conditions provide the following advantageous effects.

First, the steel with increased hardness is provided. In other words, as the hot-working temperature increases, the austenite grain size after working increases, so that the austenite grain boundary area is reduced. Since the austenite grain boundary area serves as a ferrite generation site, the reduction of the area results in a reduction of a ferrite fraction. Consequently, a pearlite fraction increases correspondingly so as to provide an increased hardness.

Furthermore, the content of N in solid solution may be increased. That is, a higher temperature of the hot working facilitates N entering into the steel in the form of solid solution N, and cooling at a prescribed rate or above precludes the generation of N compounds during cooling, thereby ensuring a high content of N in solid solution.

Furthermore, deformation resistance in hot working can be reduced. That is, a higher temperature of hot working can make the steel material the softer, and thus can decrease the deformation resistance, facilitating hot working. This can reduce the energy consumption and the wear or abrasion of, for example, molds for use therewith.

Such an advantageous effect cannot be sufficiently achieved at a temperature of hot working of 950° C. or less. It should be noted that the upper limit of the working temperature is preferably controlled to 1300° C. in order to prevent disadvantages, such as melt adhesion between the material and the mold, and damage of the mold.

Furthermore, the hot working described above can be performed by any known method such as hot forging or hot rolling.

Furthermore, while the step of hot working in the producing method may be performed one or multiple times as described above, the working temperature and the cooling rate of the last hot working prior to machining are controlled as described above. Furthermore, various types of hot working may be performed before the last hot working described herein, and additional warm working or cold working can be incorporated after the last hot working.

Furthermore, the chemical composition of the above-described steel material for friction welding may optionally further include one or more of Mo: 0.01 to 0.20%, Nb: 0.01 to 0.200, Ti: 0.01 to 0.20%, V: 0.01 to 0.30%, Ca: 0.0001 to 0.0050%, and Mg: 0.0001 to 0.0050%.

Mo: 0.01 to 0.20%

Mo (molybdenum) is effective to increase the strength, and Mo is preferably contained in the amount of not less than the lower limit described above to achieve such advantageous effect. In contrast, an excessively high Mo content may cause increased cost. Accordingly, the content is preferably set to be not more than the upper limit.

Nb: 0.01 to 0.20%

Nb (Niobium) forms fine carbide and nitride, and is therefore effective to increase the strength, and Nb is preferably contained in the amount of not less than the lower limit described above to achieve such advantageous effect. In contrast, an excessively high Nb content may cause increased cost. Accordingly, the content is preferably set to be not more than the upper limit.

Ti: 0.01 to 0.20%

Ti (titanium) forms carbide and nitride to restrain the growth of austenite crystal grains, and is therefore effective to increase toughness, and Ti is preferably contained in the amount of not less than the lower limit described above to achieve such advantageous effect. In contrast, an excessively high content of Ti may produce a significant amount of hard oxides, leading to poor machinability. Accordingly, the content is preferably set to be not more than the upper limit described above.

V: 0.01 to 0.30%

V (vanadium) forms fine carbide and nitride, and is therefore effective to increase the strength, and V is preferably contained in the amount of not less than the lower limit described above to achieve the advantageous effect. In contrary, an excessively high V content may cause increased cost. Accordingly, the content is preferably set to be not more than the upper limit.

Ca: 0.0001 to 0.0050%

Ca (calcium) is effective to improve the machinability, and Ca is preferably contained in the amount of not less than the lower limit described above to achieve such advantageous effect. In contrast, an excessively high Ca content saturates the advantageous effect. Accordingly, the content is preferably set to be not more than the upper limit.

Mg: 0.0001 to 0.0050%

Mg (magnesium) is effective for improving the machinability and reducing the anisotropy of the mechanical properties, and Mg is preferably contained in the amount of not less than the lower limit described above to achieve such advantageous effect. In contrast, an excessively high Mg content saturates the advantageous effect. Accordingly, the content is preferably set to be not more than the upper limit.

Embodiments

Embodiment 1

As an example of the above-described steel material for friction welding, steel materials having chemical compositions shown in Table 1 (Samples 1 to 17, and Samples 21 to 31) were prepared in accordance with the following manufacturing process. In a melting and casting step, a raw material was melted in a vacuum melting furnace and casted into a casting mold to prepare an ingot having an approximate size of 150 mm in diameter by 300 mm in length.

From the vicinity of the surface of the ingot, a Gleeble specimen having a size of 10 mm in diameter by 120 mm in length (a first specimen) was prepared.

Furthermore, the ingot was hot-forged into a round bar of 65 mm in diameter. The processing temperature in the hot forging was determined from the temperature of the material immediately after processing. The values are shown in Table 2. The round bar prepared by the hot forging was naturally cooled immediately after the hot forging. The cooling rate down to 500° C. was 0.3° C./sec or more, specifically in the range of 0.5 to 0.6° C./sec. A portion of the produced round bar was cut to prepare a second test piece having a size of 60 mm in diameter by 390 mm in length.

Test for Evaluating Hot Workability and Hot Deformation Resistance

The hot workability and hot deformation resistance of the first test piece were determined using a Gleeble testing machine. The hot workability (%) is represented by a reduction of area (%), which is determined by a definition: ((cross sectional area before test)−(fracture surface area after test))/(cross sectional area before test))×100. The hot workability is rated as good if the reduction of area is 95% or more. The deformation resistance was determined by a definition: (maximum deformation load)/(cross sectional area before test). If this value is 150 MPa or less, the deformation resistance may be rated as good.

Evaluation of Chip Disposability and Tool Wear Test

The second test piece was machined with an NC lathe. The machining was performed under the following conditions: cutting rate=200 m/min, feed rate=0.3 mm/rev, depth of cut=0.5 mm, and cutting time=20 min. The chip disposability was evaluated through visual observation of chips produced during machining. Chips separated into a length of 100 mm or less were judged as pass (O), whereas chips separated into a length of more than 100 mm were judged as failure (X).

The tool wear was evaluated through observation of the flank of the tool with a microscope to measure the tool wear loss. A tool wear loss of 0.3 mm or less is rated as good.

Test for Evaluating Friction Weldability

For the evaluation test of friction weldability, specimens cut out from D/4 of the second test piece (size: 15 mm in diameter by 70 mm in length) were welded to each other by a brake method. The conditions are listed below.

Friction welding was performed under the following conditions: total upset length=6 to 10 mm, friction pressure 55 MPa, upset pressure=110 MPa, friction time=15 sec, upset time=5 sec, rotational speed=3000 RPM. A V notch Charpy specimen was then sampled from the center of the welded test piece such that a notch bottom is located at the weld. The three-point bending test was performed on the specimen at a distance between support points of 40 mm. In the evaluation of friction weldability, a maximum load of the three-point flexural testing of 13,000 N or more is rated as good.

Hardness

The Vickers hardness was measured at a mirror-polished surface of the portion at the depth of ¼ the diameter from the outer surface of the second test piece in accordance with JIS 22244. The Vickers hardness is preferably 230 Hv or more.

The results of these tests are shown in Table 2.

TABLE 1

| Sample | Chemical Composition (mass %) | | | | | | | | | | | | | | N in solid solution | | |
|---|---|---|---|---|---|---|---|---|---|---|---|---|---|---|---|---|---|
| No. | C | Si | Mn | P | S | Cr | Mo | Al | Nb | Ti | V | N | Mg | Ca | (mass %) | Mn/S | Mn + 6S |
| 1 | 0.39 | 0.88 | 0.77 | 0.007 | 0.059 | 1.42 | | 0.014 | | | | 0.0092 | | | 0.0088 | 13.1 | 1.12 |
| 2 | 0.51 | 0.75 | 0.43 | 0.018 | 0.040 | 1.81 | | 0.013 | | | | 0.0084 | | | 0.0073 | 10.8 | 0.67 |
| 3 | 0.53 | 0.95 | 0.32 | 0.008 | 0.056 | 0.30 | | 0.024 | | | | 0.0140 | | | 0.0062 | 5.7 | 0.66 |
| 4 | 0.38 | 0.70 | 0.73 | 0.011 | 0.067 | 1.20 | | 0.015 | | | | 0.0120 | | | 0.0103 | 10.9 | 1.13 |
| 5 | 0.45 | 0.15 | 0.36 | 0.005 | 0.110 | 1.61 | | 0.031 | | | | 0.0181 | | | 0.0161 | 3.3 | 1.02 |
| 6 | 0.50 | 0.91 | 0.60 | 0.009 | 0.094 | 0.28 | | 0.007 | | | | 0.0130 | | | 0.0086 | 6.4 | 1.16 |
| 7 | 0.41 | 0.71 | 0.05 | 0.029 | 0.019 | 1.65 | | 0.012 | | | | 0.0089 | | | 0.0078 | 2.6 | 0.16 |
| 8 | 0.44 | 0.55 | 0.26 | 0.013 | 0.041 | 1.86 | | 0.022 | | | | 0.0153 | | | 0.0099 | 6.3 | 0.51 |
| 9 | 0.48 | 0.64 | 0.56 | 0.014 | 0.039 | 0.95 | | 0.017 | | | | 0.0065 | | | 0.0031 | 14.4 | 0.79 |
| 10 | 0.54 | 0.27 | 0.63 | 0.018 | 0.073 | 1.48 | | 0.022 | | | | 0.0095 | | | 0.0084 | 8.6 | 1.07 |
| 11 | 0.52 | 0.75 | 0.79 | 0.019 | 0.063 | 0.59 | | 0.022 | | | | 0.0075 | | | 0.0052 | 12.5 | 1.17 |
| 12 | 0.33 | 0.88 | 0.55 | 0.019 | 0.061 | 0.62 | 0.15 | 0.010 | | | | 0.0122 | | | 0.0052 | 9.0 | 0.92 |
| 13 | 0.38 | 0.41 | 0.40 | 0.025 | 0.058 | 1.25 | | 0.009 | 0.11 | | | 0.0145 | | | 0.0063 | 6.9 | 0.75 |
| 14 | 0.48 | 0.79 | 0.09 | 0.016 | 0.026 | 1.44 | | 0.013 | | 0.03 | | 0.0169 | | | 0.0075 | 3.5 | 0.25 |
| 15 | 0.52 | 0.63 | 0.31 | 0.017 | 0.065 | 0.22 | | 0.013 | | | 0.15 | 0.0184 | | | 0.0102 | 4.8 | 0.70 |
| 16 | 0.46 | 0.45 | 0.65 | 0.004 | 0.086 | 1.03 | | 0.009 | | | 0.27 | 0.0153 | | | 0.0067 | 7.6 | 1.17 |
| 17 | 0.49 | 0.39 | 0.08 | 0.024 | 0.015 | 1.54 | | 0.022 | | | | 0.0121 | 0.0018 | 0.0025 | 0.0069 | 5.3 | 0.17 |
| 21 | 0.54 | 0.32 | 0.88 | 0.018 | 0.055 | 0.31 | | 0.014 | | | 0.08 | 0.0129 | | | 0.0089 | 16.0 | 1.21 |
| 22 | 0.45 | 0.59 | 0.86 | 0.024 | 0.118 | 0.37 | | 0.025 | | | 0.17 | 0.0104 | | | 0.0048 | 7.3 | 1.57 |
| 23 | 0.61 | 0.77 | 0.21 | 0.017 | 0.054 | 1.45 | | 0.007 | | | | 0.0146 | | | 0.0117 | 3.9 | 0.53 |
| 24 | 0.45 | 0.26 | 0.79 | 0.017 | 0.030 | 1.50 | | 0.013 | | | | 0.0091 | | | 0.0089 | 26.3 | 0.97 |
| 25 | 0.53 | 0.62 | 0.06 | 0.025 | 0.074 | 0.75 | | 0.007 | | | | 0.0073 | | | 0.0055 | 0.8 | 0.50 |
| 26 | 0.54 | 0.46 | 0.09 | 0.018 | 0.004 | 1.28 | | 0.015 | | | | 0.0094 | | | 0.0053 | 22.5 | 0.11 |

TABLE 1-continued

| Sample | Chemical Composition (mass %) | | | | | | | | | | | | | | N in solid solution | | |
|---|---|---|---|---|---|---|---|---|---|---|---|---|---|---|---|---|---|
| No. | C | Si | Mn | P | S | Cr | Mo | Al | Nb | Ti | V | N | Mg | Ca | (mass %) | Mn/S | Mn + 6S |
| 27 | 0.53 | 0.92 | 0.13 | 0.011 | 0.028 | 1.39 | | 0.043 | | | | 0.0043 | | | 0.0001 | 4.6 | 0.30 |
| 28 | 0.54 | 0.43 | 0.41 | 0.008 | 0.033 | 1.59 | | 0.048 | | | | 0.0065 | | | 0.0008 | 12.4 | 0.61 |
| 29 | 0.43 | 0.55 | 0.66 | 0.024 | 0.083 | 0.75 | | 0.013 | | | | 0.0085 | | | 0.0034 | 8.0 | 1.16 |
| 30 | 0.54 | 0.26 | 0.39 | 0.003 | 0.029 | 1.74 | | 0.027 | | | 0.09 | 0.0096 | | | 0.0014 | 13.4 | 0.56 |
| 31 | 0.52 | 0.89 | 0.43 | 0.017 | 0.062 | 1.34 | | 0.021 | | | | 0.0073 | | | 0.0007 | 6.9 | 0.80 |

TABLE 2

| Sample No. | Hot-working Temperature (° C.) | Cooling Rate (° C./sec) | Hot Workability (%) | Deformation Resistance (MPa) | Chip Disposability | Tool Wear Resistance (mm) | Friction Weldability (N) | Hardness (Hv) |
|---|---|---|---|---|---|---|---|---|
| 1 | 1100 | 0.4 | 98 | 103 | ○ | 0.21 | 13800 | 259 |
| 2 | 1100 | 0.5 | 98 | 106 | ○ | 0.26 | 14800 | 291 |
| 3 | 1100 | 0.3 | 99 | 98 | ○ | 0.22 | 15100 | 238 |
| 4 | 1100 | 0.3 | 99 | 103 | ○ | 0.22 | 13500 | 250 |
| 5 | 1100 | 0.4 | 99 | 102 | ○ | 0.23 | 13200 | 249 |
| 6 | 1100 | 0.4 | 98 | 102 | ○ | 0.15 | 14300 | 237 |
| 7 | 1100 | 0.4 | 98 | 102 | ○ | 0.19 | 16800 | 245 |
| 8 | 1100 | 0.4 | 99 | 94 | ○ | 0.24 | 15900 | 275 |
| 9 | 1100 | 0.4 | 99 | 93 | ○ | 0.21 | 15800 | 235 |
| 10 | 1200 | 0.5 | 99 | 77 | ○ | 0.29 | 14100 | 300 |
| 11 | 1000 | 0.4 | 98 | 129 | ○ | 0.20 | 13500 | 238 |
| 12 | 1100 | 0.4 | 99 | 103 | ○ | 0.24 | 14200 | 247 |
| 13 | 1100 | 0.5 | 98 | 96 | ○ | 0.27 | 15400 | 260 |
| 14 | 1100 | 0.5 | 96 | 107 | ○ | 0.23 | 16900 | 274 |
| 15 | 1100 | 0.4 | 99 | 90 | ○ | 0.23 | 14700 | 252 |
| 16 | 1100 | 0.4 | 99 | 99 | ○ | 0.28 | 13800 | 323 |
| 17 | 1100 | 0.5 | 98 | 95 | ○ | 0.22 | 14300 | 258 |
| 21 | 1100 | 0.4 | 99 | 96 | x | 0.26 | 10400 | 280 |
| 22 | 1100 | 0.4 | 99 | 104 | ○ | 0.26 | 9300 | 281 |
| 23 | 1100 | 0.5 | 99 | 106 | ○ | 0.32 | 14200 | 294 |
| 24 | 1100 | 0.5 | 99 | 100 | x | 0.26 | 14600 | 265 |
| 25 | 1100 | 0.5 | 68 | 102 | ○ | 0.22 | 14500 | 235 |
| 26 | 1100 | 0.5 | 99 | 108 | x | 0.34 | 18200 | 268 |
| 27 | 1100 | 0.5 | 99 | 107 | ○ | 0.35 | 15700 | 287 |
| 28 | 1100 | 0.5 | 98 | 98 | ○ | 0.34 | 16300 | 283 |
| 29 | 900 | 0.4 | 89 | 170 | ○ | 0.19 | 14100 | 220 |
| 30 | 900 | 0.4 | 92 | 163 | ○ | 0.32 | 17400 | 286 |
| 31 | 1100 | 0.2 | 98 | 92 | ○ | 0.33 | 14600 | 283 |

Tables 1 and 2 demonstrate that Samples No. 1 to No. 17 were excellent in all evaluation items.

Sample No. 21 was poor in chip disposability due to failure to satisfy the relationship: Mn/S<15 in Expression (1) and was not good in friction weldability due to failure to satisfy the relationship: Mn+6S<1.2 in Expression (2).

Sample 22 was not good in friction weldability due to failure to satisfy the relationship: Mn+6S<1.2 in Expression (2). Sample 23 was not good in tool wear resistance because of the excess c content in the chemical composition.

Sample 24 was poor in chip disposability due to failure to satisfy the relationship: Mn/S<15 in Expression (1). Sample 25 was not good in hot workability due to failure to satisfy the relationship: 2.6 Mn/S in Expression (1).

Sample No. 26 was poor in chip disposability due to failure to satisfy the relationship: Mn/S<15 in Expression (1), and also poor in tool wear resistance caused by a significantly low S content in the chemical composition. Samples No. 27, No. 28, and No. 31 are not good in tool wear resistance caused by a significantly low content of dissolved N.

Sample No. 29 was poor in hot workability, excessively high in hot deformation resistance, and further significantly low in hardness, all of which were caused by significantly low hot-working temperature. Sample No. 30 was poor in hot workability and excessively high in hot deformation resistance caused by a significantly low hot-working temperature, and is not good in tool wear resistance caused by a significantly low content of dissolved N.

These evaluation results demonstrate that the steel material for friction welding can achieve not only improved friction weldability, but also superior chip disposability and tool wear resistance during machining because having the chemical composition specified above, wherein the contents of Mn and S is regulated to satisfy the relationship expressed by the above-described Expressions (1) and (2), and the content of N in solid solution is controlled to a specific value.

The evaluation results also demonstrates that the producing method can provide a steel material for friction welding which exhibits excellent properties as described above and improve the hot workability in the production process by preparing a material having the chemical composition described above wherein the relationships expressed by the Expressions (1) and (2) are satisfied, performing hot working under the conditions of a working temperature of more than 950° C., and cooling at a cooling rate of 0.3° C./sec or more after hot working at least until the temperature reaches 500° C.

The invention claimed is:

1. A method for producing a steel material for friction welding, comprising:

preparing a material having a chemical composition comprising, in mass percent, C: 0.30 to 0.55%, Si: 0.05 to 1.0%, Mn: 0.05 to 0.9%, S: 0.005 to 0.12%, Cr: 0.22 to 2.00%, Al: 0.005 to 0.05%, N: 0.0050 to 0.0200%, the balance being Fe and unavoidable impurities, wherein the contents of Mn and S satisfy relationships expressed by following expressions:

$$2.6 \leq Mn/S < 15 \quad (1) \text{ and}$$

$$Mn + 6S < 1.2 \quad (2)$$

in which Mn and S represent the contents in mass percent of manganese and sulfur, respectively, hot-working the material at least one time, the last hot working being performed at a working temperature exceeding 1000° C. throughout the last hot working, to obtain an amount of N in solid solution in the material of not less than 0.0020%, and cooling the material after the last hot working at a cooling rate of 0.3° C./sec or more at least until the temperature reaches 500° C.

2. The method for producing a steel material for friction welding according to claim 1, wherein the chemical composition further comprises one or more of Mo: 0.01 to 0.20%, Nb: 0.01 to 0.20%, Ti: 0.01 to 0.20%, V: 0.01 to 0.30%, Ca: 0.0001 to 0.0050%, and Mg: 0.0001 to 0.0050%, in place of part of the balance.

3. The method for producing a steel material for friction welding according to claim 1, wherein the content of N is from 0.012% to 0.020%.

4. The method for producing a steel material for friction welding according to claim 1, wherein the working temperature of the last hot working exceeds 1000° C. and is less than or equal to 1300° C. throughout the last hot working.

5. The method for producing a steel material for friction welding according to claim 1, wherein the hot working is hot forging.

6. The method for producing a steel material for friction welding according to claim 1, wherein the hot working is hot rolling.

7. The method for producing a steel material for friction welding according to claim 1, wherein the content of N is from 0.010% to 0.020%.

* * * * *